US007522106B2

(12) United States Patent
Lim et al.

(10) Patent No.: US 7,522,106 B2
(45) Date of Patent: Apr. 21, 2009

(54) ANTENNA HAVING EXTENDED OPERATION FREQUENCY BANDWIDTH

(75) Inventors: Yohan Lim, Anyang-si (KR); Kihun Chang, Seoul (KR); Young Joong Yoon, Seoul (KR); Ick-Jae Yoon, Seoul (KR); Young-Eil Kim, Suwon-si (KR); Yongjin Kim, Suwon-si (KR)

(73) Assignees: Samsung Electronics Co., Ltd., Suwon-si (KR); Industry-Academic Cooperation Foundation, Yonsei University, Seoul (KR)

( * ) Notice: Subject to any disclaimer, the term of this patent is extended or adjusted under 35 U.S.C. 154(b) by 7 days.

(21) Appl. No.: 11/594,114

(22) Filed: Nov. 8, 2006

(65) Prior Publication Data

US 2007/0273590 A1 Nov. 29, 2007

(30) Foreign Application Priority Data

May 26, 2006 (KR) ..... 10-2006-0047457

(51) Int. Cl.
*H01Q 1/38* (2006.01)

(52) U.S. Cl. ..... 343/700 MS; 343/702; 343/765

(58) Field of Classification Search ..... 343/700 MS
See application file for complete search history.

(56) References Cited

U.S. PATENT DOCUMENTS

| | | | | |
|---|---|---|---|---|
| 4,012,741 | A * | 3/1977 | Johnson | 343/700 MS |
| 6,373,436 | B1 * | 4/2002 | Chen et al. | 343/702 |
| 2002/0145569 | A1 | 10/2002 | Onaka et al. | |
| 2005/0128151 | A1 | 6/2005 | Kwak et al. | |
| 2006/0139214 | A1 | 6/2006 | Deng et al. | |

FOREIGN PATENT DOCUMENTS

WO WO 03/075398 A1 9/2003

* cited by examiner

*Primary Examiner*—Trinh V Dinh
(74) *Attorney, Agent, or Firm*—Sughrue Mion, PLLC

(57) ABSTRACT

An antenna having an extended operation frequency bandwidth that includes: a feed, and a plurality of radiators which are connected to the feed to receive current and divided at the feed. Accordingly, the RFID radio signals and the mobile communication radio signals can be transmitted and received via the single antenna because the frequency bandwidth is expanded. Therefore, the efficiency of the antenna can be improved and the mobile communication terminal can be miniaturized. Furthermore, since the antenna obtains the increased gain, the communication quality of the antenna can be enhanced and the power consumption can be reduced.

7 Claims, 3 Drawing Sheets

ANTENNA HAVING EXTENDED OPERATION FREQUENCY BANDWIDTH

CROSS-REFERENCE TO RELATED APPLICATIONS

This application claims priority from Korean Patent Application No. 10-2006-0047457 filed on May 26, 2006 in the Korean Intellectual Property Office, the disclosure of which is incorporated herein by reference.

BACKGROUND OF THE INVENTION

1. Field of the Invention

Apparatuses consistent with the present invention relate to an antenna having an extended operation frequency bandwidth. More particularly, the present invention relates to an antenna having an extended operation frequency bandwidth, which enables transmission and reception of RFID signals and radio signals via a single antenna.

2. Description of the Related Art

Recently, ubiquitous sensor network (USN) is attracting attention as a basic infrastructure for realizing a ubiquitous society which is becoming extremely important in the area of information technology.

The USN is a technique that attaches a communicable tag to all objects: detects environment information based on recognition information of the objects, which is acquired from using the tags; and manages and utilizes this detected information over networks. The core of the USN is a radio frequency identification (RFID) system. The RFID system includes: a reader, an antenna, a tag, a server, and a network. The reader is responsible for reading and storing information to and from the tag. The antenna is responsible for exchanging the data stored from the tag in a certain frequency according to a certain protocol.

Convergence of the RFID system and mobile communication produces a new technique and service called a mobile RFID (mRFID). The mRFID includes: a tag, a reader, an antenna, and a processing module mounted to the mobile communication terminal. This mRFID technique provides useful information services to a user by reading out information from other tags, or forwarding information from the mobile communication terminal to another device using the tag of the mobile communication terminal.

Meanwhile, an RFID antenna adapted to the mRFID technique transmits and receives radio signals in the band of 908.5~914 MHz, whereas a communication antenna dedicated to the mobile communication terminal transmits and receives radio signals in the band of 824~896 MHz. There is a small difference between the bands for the RFID radio signals and the mobile communication radio signals. However, since a mobile communication antenna of a conventional mobile communication terminal uses the narrowband, it is difficult to effectively transmit and receive even the RFID radio signals. Hence, the conventional mobile communication terminal separately employs and uses the RFID antenna and the mobile communication antenna in order to implement the mRFID technique.

As such, when the RFID antenna and the mobile communication antenna are provided separately, the increased size of the mobile communication terminal is inevitable. This size increase is contrary to the technological advancements in mobile communication terminals for making mobile communication terminals smaller through miniaturization and integration of the mobile communication antenna.

Therefore, it is possible to avoid the size increase of the mobile communication terminal, due to the plurality of antennas having to be mounted, by transmitting and receiving both the RFID radio signals and the mobile communication radio signals via a single antenna.

SUMMARY OF THE INVENTION

The present invention has been provided to address the above-mentioned and other problems and disadvantages occurring in the conventional arrangement, and an aspect of the present invention provides an antenna having an operation frequency bandwidth to transmit and receive both RFID radio signals and mobile communication radio signals.

According to an aspect of the present invention, an antenna having an extended operation frequency bandwidth includes a feed; and a plurality of spaced radiators at certain intervals from each other, which are connected to the feed and receives current therefrom.

A connection feed may be disposed between the feed and each of the radiators, the connection feed formed lengthwise in the arrangement direction of the radiators.

Each of the radiators may include a first radiating surface connected to the connection feed, a second radiating surface bent from the first radiating surface, and a third radiating surface bent from the second radiating surface in parallel with the first radiating surface.

A radiator at ends of the connection feed may further include an extended surface which is protruded perpendicularly from a side of the second radiating surface, and bent and extended in parallel with the second radiating surface.

The extended surface may be extended to a radiator at the center of the connection feed.

A radiator at ends of the connection feed may have the first, second, and third radiating surfaces that are wider than the radiator at the center of the connection feed.

The first radiating surface may have an increasing width from an area connected to the connection feed to an area connected to the second radiating surface.

A short may be connected to the connection feed, where the short provides a ground for the currents circulating the radiators.

The feed and the short may be arranged on one side of a circuit board having the ground, and the radiators are arranged on the other side of the circuit board.

BRIEF DESCRIPTION OF THE DRAWING FIGURES

These and/or other aspects of the present invention will become more apparent and more readily appreciated from the following description of exemplary embodiments thereof, with reference to the accompanying drawings, in which.

DETAILED DESCRIPTION OF EXEMPLARY EMBODIMENTS

Figure 1:
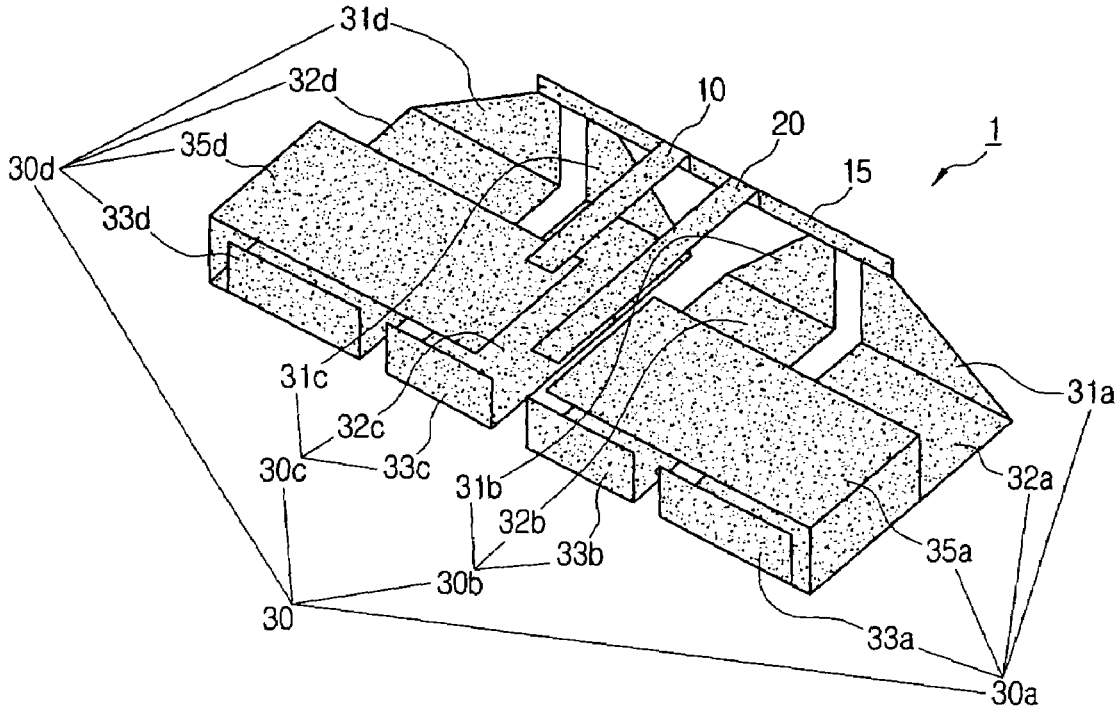
FIG. 1 is a perspective view of a planar inverted-F antenna (PIFA) according to an exemplary embodiment of the present invention.

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

Figure 2:
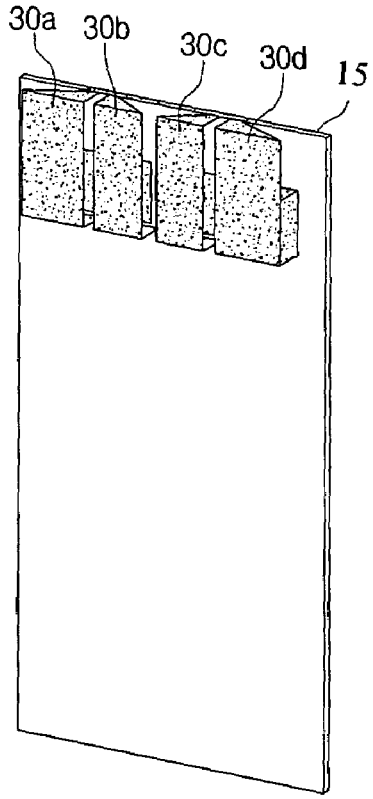
FIG. 2 is a front perspective view of the PIFA of FIG. 1, which is mounted on a circuit board.
Figure 3:
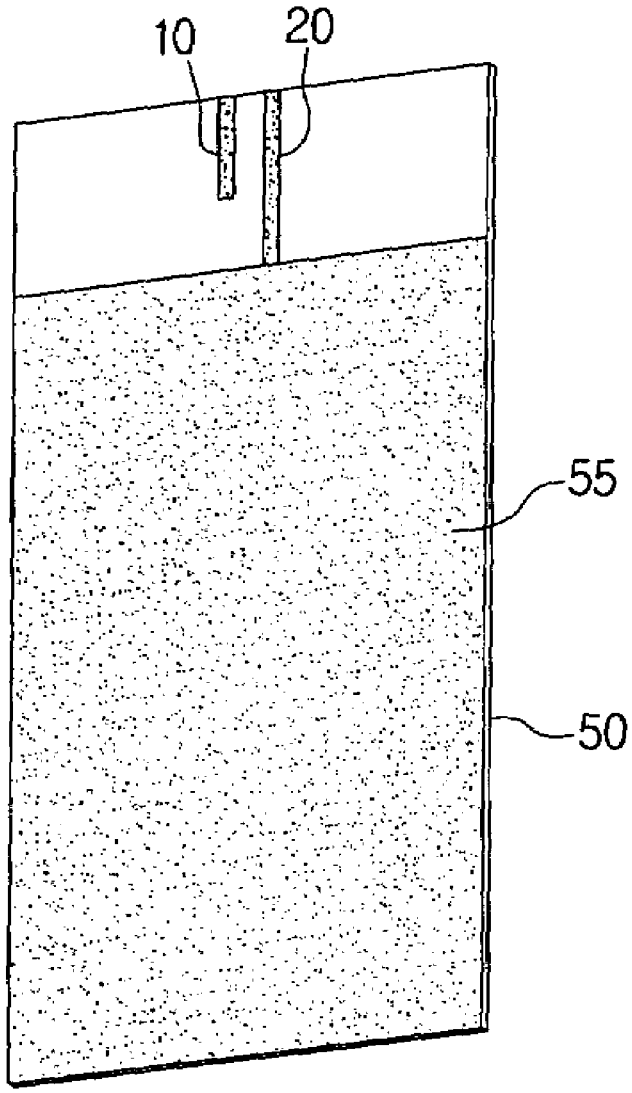
FIG. 3 is a rear perspective view of the PIFA of FIG. 1, which is mounted on the circuit board.

FIG. 1 is a perspective view of a planar inverted-F antenna (PIFA) according to an exemplary embodiment of the present invention, FIG. 2 is a front perspective view of the PIFA antenna of FIG. 1, which is mounted on a circuit board, and FIG. 3 is a rear perspective view of the PIFA antenna of FIG. 1, which is mounted on the circuit board.

The PIFA 1 includes a feed 10, a short 20, a plurality of radiators 30, and a ground 55.

The feed 10 provides current to the plurality of the radiators 30. The feed 10 is in a band shape. A connection feed 15 is provided between the feed 10 and the radiators 30, connecting the feed 10 to the respective ends of the radiators 30. The connection feed 15 is also in a long band shape, and coupled with one end of the feed 10. The feed 10 is substantially at a right angle with the connection feed 15.

The short 20 provides the currents circulating the radiators 30 to the ground 55. The short 20 is connected to the connection feed 15 in parallel with the feed 10. One end of the short 20 is extended to the ground 55.

The plurality of the radiators 30 are arranged in the longitudinal direction of the connection feed 15. In FIG. 1, four radiators 30 are coupled to the connection feed 15. In the exemplary embodiment of the present invention, the radiators 30 are referred to as first through fourth radiators 30*a* through 30*d*. The first through fourth radiators 30*a* through 30*d* include first radiating surfaces 31*a* through 31*d* connected to the connection feed 15, second radiating surfaces 32*a* through 32*d* bent from the first radiating surfaces 31*a* through 31*d*, and third radiating surfaces 33*a* through 33*d* bent from the second radiating surfaces 32*a* through 32*d* in parallel with the first radiating surfaces 31*a* through 31*d*.

The first radiating surfaces 31*a* through 31*d* are formed in a triangular shape with the increasing width from the connection feed 15 to the second radiating surfaces 32*a* through 32*d*. The second radiating surfaces 32*a* through 32*d* and the third radiating surfaces 33*a* through 33*d* are formed in a rectangular shape, respectively. The distance of the third radiating surfaces 33*a* through 33*d* from the area bent from the second radiating surfaces 32*a* through 32*d* to their free ends is equal to or smaller than the distance from the connection feed 15 of the first radiating surfaces 31*a* through 31*d* to the second radiating surfaces 32*a* through 32*d*.

Each of the first radiating surfaces 31*a* through 31*d* have the same length, each of the second radiating surfaces 32*a* through 32*d* have the same length, and each of the third radiating surfaces 33*a* through 33*d* have the same length in the first through fourth radiators 30*a* through 30*d*, but the width may differ depending on the radiators 30*a* through 30*d*. As shown in FIG. 1, the width of the first, second, and third radiating surfaces 31*a*, 31*d*, 32*a*, 32*d*, 33*a*, and 33*d* of the first and fourth radiators 30*a* and 30*d* at the ends of the connection feed 15 is greater than the width of the first, second, and third radiating surfaces 31*b*, 31*c*, 32*b*, 32*c*, 33*b*, and 33*c* of the second and third radiators 30*b* and 30*c* at the center.

The first and fourth radiators 30*a* and 30*d* further include extended surfaces 35*a* and 30*d*, respectively, which are bent and protruded from the outer side of the second radiating surfaces 32*a* and 32*d* in the bending direction of the third radiating surfaces 33*a* and 33*d*, re-bent and extended in parallel with the second radiating surfaces 32*a* and 32*d*. The extended surface 35*a* of the first radiator 30*a* extends as far as the second radiating surface 32*b* of the second radiator 30*b* and the extended surface 35*d* of the fourth radiator 30*d* extends as far as the second radiating surface 32*c* of the third radiator 30*c*. The extended surfaces 35*a* and 35*d* lengthen the first and fourth radiators 30*a* and 30*d* and thus lower the resonance point of the antenna 1.

The ground 55 of the PIFA antenna 1 can be provided separately or employ the circuit board 50 of the mobile communication terminal. As shown in FIG. 2 and FIG. 3, when the circuit board 50 is provided, the feed 10 and the short 20 are arranged on one side of the circuit board 50 having the ground 55, and the radiators 30 are arranged on the other side of the circuit board 50. The connection feed 15 is arranged on the edge between the one side and the other side of the circuit board 50.

Through the long band of the feeding point formed along the connection feed 15, current is fed to the first through fourth radiators 30*a* through 30*d* effectively. That is, the PIFA antenna 1 is able to provide proper distribution of current over the first through fourth radiators 30*a* through 30*d* through the long band type of connection feed 15. This effective current distribution can increase the effective areas of the antenna and subsequently increase the efficiency of the antenna.

Figure 4:
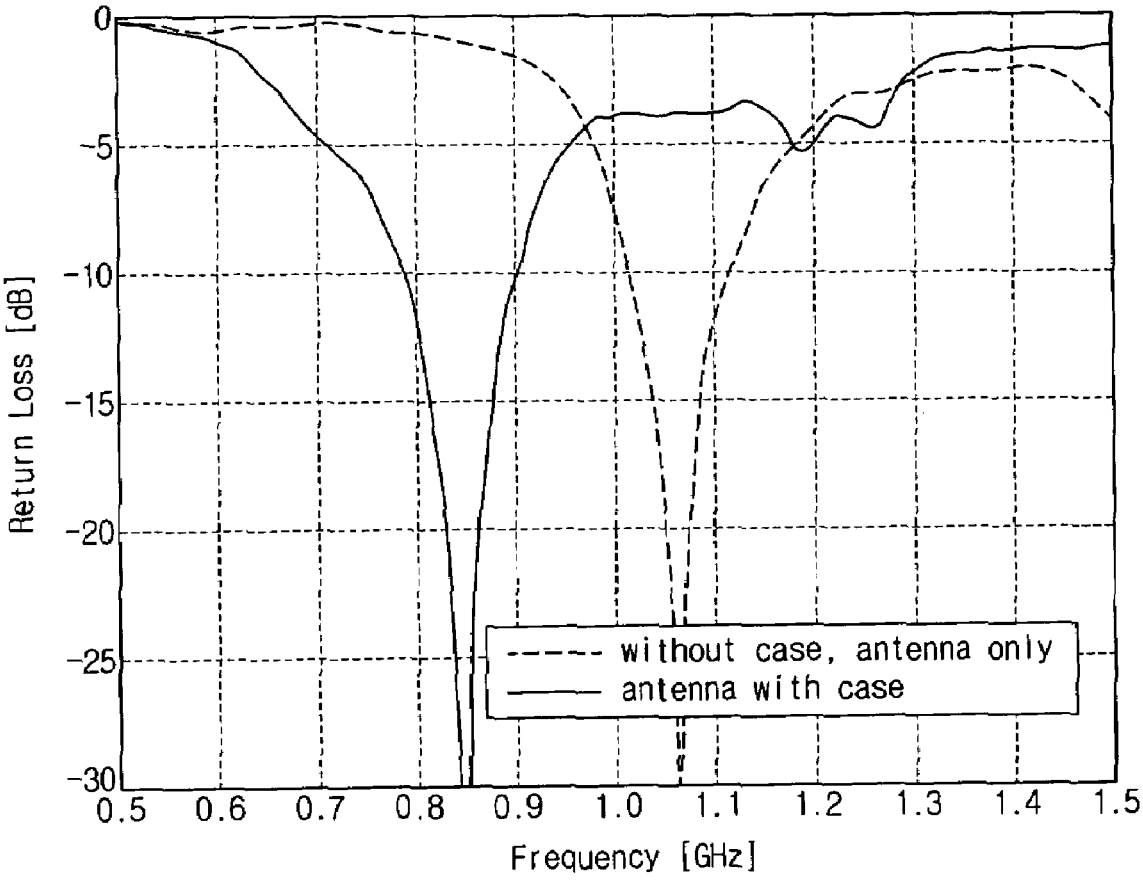
FIG. 4 is a graph showing S-parameter of the PIFA according to an exemplary embodiment of the present invention.

FIG. 4 is a graph showing S-parameter of the PIFA 1 according to an exemplary embodiment of the present invention. The dotted line indicates the S11 graph without a casing of the mobile communication terminal, and the solid line indicates the S11 graph with a casing of the mobile communication terminal.

With the casing, the S11 characteristic of the PIFA antenna 1 forms the resonance point in the 850 MHz band and shows a frequency bandwidth of about 130 MHz at −10 dB. In other words, the PIFA antenna 1 enables the transmission and the reception of the radio signals in the 780~910 MHz band which covers both the RFID radio signal frequency band of 908.5~914 MHz and the mobile communication radio signal frequency band of 824~896 MHz. This implies that the transmission and the reception of the RFID radio signals and the mobile communication radio signals can be transmitted and received via a single PIFA antenna 1.

The gain of the PIFA antenna 1 is −1.0 dB in the 900 MHz band as shown in Table 1, which is greater than the typical gain of other mobile communication terminals.

TABLE 1

| | Frequency band | | | | |
|---|---|---|---|---|---|
| | 800 MHz | 900 MHz | 1 GHz | 1.1 GHz | 1.2 GHz |
| Gain (dB) | −2.0 | −1.0 | −1.8 | −5.3 | −1.8 |

The PIFA antenna 1, as constructed above, builds the plurality of the current paths, by connecting the plurality of the radiators 30 to the single feed 10. Since the current is uniformly distributed to the radiators 30, the frequency bandwidth is extended. Therefore, it is possible to transmit and receive the RFID radio signals and the mobile communication radio signals at the same time. In other words, this eliminates the need to separately mount the RFID antenna and the mobile communication antenna, as a result, the mobile communication terminal can be miniaturized.

Also, the antenna 1 acquires improved gain with directionality, because the plurality of the radiators 30 functions as an array antenna. Since the receive sensitivity of the antenna 1 is enhanced, the antenna 1 acquires improved communication quality, reduced power consumption, and directionality which meets the requirements of RFID.

The PIFA antenna 1 expands the frequency bandwidth by using the plurality of the radiators 30, and lowers the resonance point. Also, the PIFA antenna 1 increases the gain, by forming the radiators 30 in a three-dimensional shape. Therefore, the design of the antenna 1 can adapt the general rules and thus reduces its manufacturing cost with simple fabrication.

As set forth above, the RFID radio signals and the mobile communication radio signals can now be transmitted and received via a single antenna, because the frequency bandwidth is expanded. Therefore, the efficiency of the antenna 1 can be improved and the mobile communication terminal can be miniaturized. Furthermore, since the antenna 1 obtains the increased gain and the directionality, the communication quality of the antenna 1 can be enhanced and the power consumption can be reduced.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. An antenna having an extended operation frequency bandwidth, comprising:

a feed; and a plurality of spaced radiators at certain intervals from each other, which are connected to the feed and receive current therefrom;

wherein each of first radiating elements of the plurality of spaced radiators is formed in a triangular shape with an increasing width from a connection feed point to a respective second radiation elements of the plurality of spaced radiators;

a connection feed is disposed between the feed and each of the radiators, where the connection feed is formed lengthwise in a direction in which the radiators are arranged; and each of the radiators includes the first radiating element connected to the connection feed, the second radiating element bent from the first radiating element, and a third radiating element bent from the second radiating element so as to face the first radiating element wherein the plurality of spaced radiators are formed in a three-dimensional shape.

2. The antenna as claimed in claim 1, wherein at least one radiator at an end of the connection feed further includes an extended surface that protrudes perpendicularly from a side of the second radiating element, and is bent and extended in parallel with the second radiating element.

3. The antenna as claimed in claim 2, wherein the extended surface is extended to a radiator at the center of the connection feed.

4. The antenna as claimed in claim 1, wherein at least one radiator, of the plurality of radiators, at an end of the connection feed has the first, second and third radiating elements that are wider than a radiator at the center of the connection feed.

5. The antenna as claimed in claim 1, wherein the first radiating element has an increasing width from an area connected to the connection feed to an area connected to the second radiating element.

6. The antenna as claimed in claim 1, wherein a short is connected to the connection feed, and the short provides a ground for the currents circulating the radiators.

7. The antenna as claimed in claim 6, wherein the feed and the short are arranged on one side of a circuit board having the ground, and the radiators are arranged on the other side of the circuit board.

* * * * *